US008785804B2

(12) United States Patent
Gibson

(10) Patent No.: US 8,785,804 B2
(45) Date of Patent: Jul. 22, 2014

(54) ELECTRICAL CURRENT INTERRUPTING DEVICE

(75) Inventor: Lloyd Dean Gibson, Piedmont, SC (US)

(73) Assignee: Cooper Technologies Company, Houston, TX (US)

( * ) Notice: Subject to any disclaimer, the term of this patent is extended or adjusted under 35 U.S.C. 154(b) by 821 days.

(21) Appl. No.: 13/009,168

(22) Filed: Jan. 19, 2011

(65) Prior Publication Data

US 2012/0181153 A1 Jul. 19, 2012

(51) Int. Cl.
*H01H 33/02* (2006.01)

(52) U.S. Cl.
USPC ..... 218/152; 218/131; 218/138

(58) Field of Classification Search
USPC ..... 218/131, 138, 152–155
See application file for complete search history.

(56) References Cited

U.S. PATENT DOCUMENTS

| | | | | | |
|---|---|---|---|---|---|
| 3,720,904 | A * | 3/1973 | De Sio | 439/131 |
| 4,123,618 | A * | 10/1978 | Cushing et al. | 174/11 BH |
| 4,124,790 | A * | 11/1978 | Kumbera et al. | 218/138 |
| 4,568,804 | A * | 2/1986 | Luehring | 218/138 |
| 4,707,577 | A | 11/1987 | Tamaki et al. | |
| 4,713,505 | A * | 12/1987 | Date et al. | 200/568 |
| 5,600,112 | A | 2/1997 | Opfer | |
| 5,808,258 | A | 9/1998 | Luzzi | |
| 6,198,062 | B1 * | 3/2001 | Mather et al. | 218/152 |
| 6,723,940 | B1 * | 4/2004 | Book et al. | 218/155 |
| 6,770,832 | B2 | 8/2004 | Marchand et al. | |
| 2004/0012201 | A1 | 1/2004 | Bartholoma et al. | |
| 2005/0040604 | A1 | 2/2005 | Dunford et al. | |
| 2010/0170774 | A1 * | 7/2010 | Einschenk et al. | 200/48 R |

OTHER PUBLICATIONS

International Search Report and Written Opinion for corresponding PCT application No. PCT/US2012/021485, mailed May 23, 2012 (12 pages).

* cited by examiner

*Primary Examiner* — Truc Nguyen
(74) *Attorney, Agent, or Firm* — King & Spalding LLP

(57) ABSTRACT

A switching assembly for interrupting current from an upper terminal to a lower terminal. The switching assembly includes an upper bushing, a lower bushing sealably coupled to the upper bushing, the upper terminal coupled to the upper bushing, at least one lower terminal, and a switching medium positioned within a channel formed within the upper bushing. The lower terminal is electrically coupled to the switching medium. According to some embodiments, one or more of the lower terminals are coupled into one or more lower terminal openings formed within at least one of the upper bushing and the lower bushing. According to some exemplary embodiments, the assembly includes a modular terminal ring positioned between the upper bushing and the lower bushing and sealably coupled to both. The one or more lower terminals are coupled into one or more lower terminal openings formed within a perimeter of the modular terminal ring.

24 Claims, 6 Drawing Sheets

ELECTRICAL CURRENT INTERRUPTING DEVICE

TECHNICAL FIELD

The present invention relates to devices for interrupting the flow of current. More specifically, the present invention relates to switching assemblies that include a bushing.

BACKGROUND

A switching assembly is a type of device that interrupts the flow of current. Some switching assemblies are used in systems that interrupt the flow of electricity in a high voltage electrical circuit. FIG. 1A shows a perspective view of a conventional switching assembly 100. FIG. 1B shows a perspective cross-sectional view of the conventional switching assembly 100 of FIG. 1A. Referring to FIGS. 1A and 1B, the conventional switching assembly 100 includes a single-piece bushing 110, an upper terminal 120, a fixed lower terminal 130, and a switching medium 140.

The single-piece bushing 110 is integrally formed and includes a first end 111, a second end 112, a sidewall 113 extending from substantially the perimeter of the first end 111 to substantially the perimeter of the second end 112, and a cavity 109 extending from the first end 111 to the second end 112 within the single-piece bushing 110. The sidewall 113 includes a first portion 114 and a second portion 115. The first portion 114 is substantially conical-shaped and extends from the first end 111 towards the second end 112 and integrally transitions into the second portion 115. The second portion 115 is substantially cylindrical-shaped and extends from the second end 112 towards the first end 111 and integrally transitions into the first portion 114. According to FIGS. 1A and 1B, the first end 111 has a smaller circumference than the second end 112.

The single-piece bushing 110 also includes an upper terminal opening 116, a fixed lower terminal opening 117, a flange 118, and a plurality of weathersheds 119. The upper terminal opening 116 is formed at the first end 111 and is dimensioned to receive the upper terminal 120. The fixed lower terminal opening 117 is formed along the first portion 115 and is dimensioned to receive the fixed lower terminal 130. The flange 118 is formed at the second end 112 and is coupleable to a tank (not shown) in a sealed manner. A seal (not shown) is insertable into the underside area of the flange 118, which thereby allows the flange 118 to be sealably coupled to the tank. The weathersheds 119 are integrally formed along the sidewall 113 and extend radially outward from the sidewall 113. A portion of the weathersheds 119 is located along the first portion 114 of the sidewall 113 above the fixed lower terminal opening 117, while another portion of the weathersheds 119 is located along the second portion 115 of the sidewall 113. The design of the single-piece bushing 110 can be redesigned depending upon the system design requirements. For example, the length of the single-piece bushing 110 can be made longer or shorter. Also, the number and diameters of the weathersheds 119, along the first portion 114 and/or along the second portion 115, can be increased or decreased. Further, the shape of the sidewall 113 can be different. However, any changes to the design of the single-piece bushing 110 will need a change in the design of the tool (not shown) used to fabricate the single-piece bushing 110, thereby increasing fabrication costs.

The upper terminal 120 is fabricated using an electrically conductive material and is inserted at least partially within the upper terminal opening 116. The upper terminal 120 includes threads (not shown) which couple to mating threads (not shown) positioned within the upper terminal opening 116. Once coupled to the single-piece bushing 110, the exposed portion of the upper terminal 120 provides a connection point to an electrical source (not shown), thereby allowing current to enter into the conventional switching assembly 100. The shape and materials used to fabricate the upper terminal 120 are known to people having ordinary skill in the art.

The fixed lower terminal 130 is fabricated using an electrically conductive material and is inserted at least partially within the fixed lower terminal opening 117. The fixed lower terminal 130 includes threads (not shown) which couple to mating threads (not shown) positioned within the fixed lower terminal opening 117. The fixed lower terminal 130 is located in a fixed manner with respect to the single-piece bushing 110. Once coupled to the single-piece bushing 110, the exposed portion of the fixed lower terminal 130 provides a connection point to a load (not shown), thereby allowing current to exit the conventional switching assembly 100. The shape and materials used to fabricate the fixed lower terminal 130 is known to people having ordinary skill in the art. Although the upper terminal 120 is electrically coupled to the electrical source and the fixed lower terminal 130 is electrically coupled to the load, the upper terminal 120 is electrically coupled to the load and the fixed lower terminal 130 is electrically coupled to the electrical source in other examples.

The switching medium 140 is located within the cavity 109 and is electrically coupled to both the upper terminal 120 and the fixed lower terminal 130. The switching medium 140 is electrically coupled to the fixed lower terminal 130 using an electrical pathway 150, which also is located within the cavity 109. The electrical pathway 150 can be a flexible copper wire. When in the closed condition, the switching medium 140 allows electrical current to flow from the upper terminal 120 to the fixed lower terminal 130. When in the open condition, however, the switching medium 140 prevents electrical current to flow from the upper terminal 120 to the fixed lower terminal 130. Although not described in detail, other components can be inserted into the cavity 109. For example, a buffer material (not shown), such as polyurethane foam, urethane, or silicone, is insertable within a portion of the cavity 109 which extends from about the upper portion of the switching medium 140 to about the uppermost portion of the cavity 109. The buffer material is usable in many types of switching mediums 140, such as a vacuum bottle type, to improve the resistance of electrical discharge across the device and act as a thermal expansion buffer. Although not shown, a control device is interfaced with the switching medium 140 through a series of electromechanical interconnections, which determines when the switching medium 140 is to operate and interrupt the flow of current. This control device can be located within the cavity 109 or outside the cavity 109 depending upon the design choices.

The conventional switching assembly 100 is often difficult to install in service due to the fixed location of the fixed lower terminal 130. The fixed lower terminal 130 should be accessible, but oftentimes is not, for electrically coupling the load thereto. The installation of the conventional switching assembly 100 in service requires extensive engineering and planning, and may involve some degree of disassembly of the conventional switching assembly 100 from the tank. For example, in situations where the fixed lower terminal 130 is not accessible, the flange 118 of the conventional switching assembly 100 is disassembled from the tank, the conventional switching assembly 100 is rotated so that the location of the fixed lower terminal 130 is accessible, and the conventional switching assembly 100 is reassembled to the tank. During this reassembly, the seal between the flange 118 and the tank can be compromised, thereby allowing a path for moisture and environmental contamination to enter the conventional switching assembly 100.

SUMMARY

One exemplary embodiment described herein includes a switching assembly. The switching assembly can include an upper bushing, a lower bushing, a modular terminal ring, an upper terminal, at least one lower terminal, and a switching medium. The upper bushing can form an upper bushing channel therein and an upper terminal opening extending from the upper bushing channel through the surface of the upper bushing. The lower bushing can form a lower bushing channel therein. The modular terminal ring can include an upper surface, a lower surface, and a sidewall. The sidewall can extend substantially from the perimeter of the upper surface to substantially the perimeter of the lower surface. The sidewall can form at least one lower terminal opening around the perimeter of the sidewall. The upper surface can be sealably coupled to the upper bushing and the lower surface can be sealably coupled to the lower bushing. The upper terminal can be coupled to the upper bushing through the upper terminal opening. Each lower terminal can be coupled to one of the lower terminal openings. The switching medium can be disposed within the upper bushing channel. The switching medium can electrically couple the upper terminal to the lower terminals when in a closed state and can electrically discouple the upper terminal to the lower terminals when in an open state.

Another exemplary embodiment includes a switching assembly. The switching assembly can include an upper bushing, a lower bushing, an upper terminal, at least one lower terminal, and a switching medium. The upper bushing can form an upper bushing channel therein and an upper terminal opening extending from the upper bushing channel through the surface of the upper bushing. The lower bushing can form a lower bushing channel therein. The lower bushing can be sealably coupled to the upper bushing. The upper terminal can be coupled to the upper bushing through the upper terminal opening. Each lower terminal can be coupled to at least one lower terminal opening. The lower terminal openings can be formed within at least one of the upper bushing and the lower bushing. The switching medium can be disposed within the upper bushing channel. The switching medium can electrically couple the upper terminal to the lower terminals when in a closed state and can electrically discouple the upper terminal to the lower terminals when in an open state.

Another exemplary embodiment includes a method for assembling a switching assembly. The method can include obtaining an upper bushing, a lower bushing, and a modular terminal ring. The method also can include inserting a switching medium into an upper bushing channel formed within the upper bushing. The method also can include sealably coupling one end of the modular terminal ring to one end of the upper bushing. The method also can additionally include electrically coupling the switching medium to the modular terminal ring using an electrical pathway. The method can further include sealably coupling an opposing end of the modular terminal to one end of the lower bushing. The method can also include coupling an upper terminal to the upper bushing through an upper terminal opening formed within the upper bushing. The method can further include coupling at least one lower terminal to the modular terminal ring through at least one lower terminal opening formed around the perimeter of the modular terminal ring. The switching medium can electrically couple the upper terminal to the lower terminals when in a closed state and can electrically discouple the upper terminal to the lower terminals when in an open state.

BRIEF DESCRIPTION OF THE DRAWINGS

The foregoing and other features and aspects of the invention may be best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

Figure 1B:
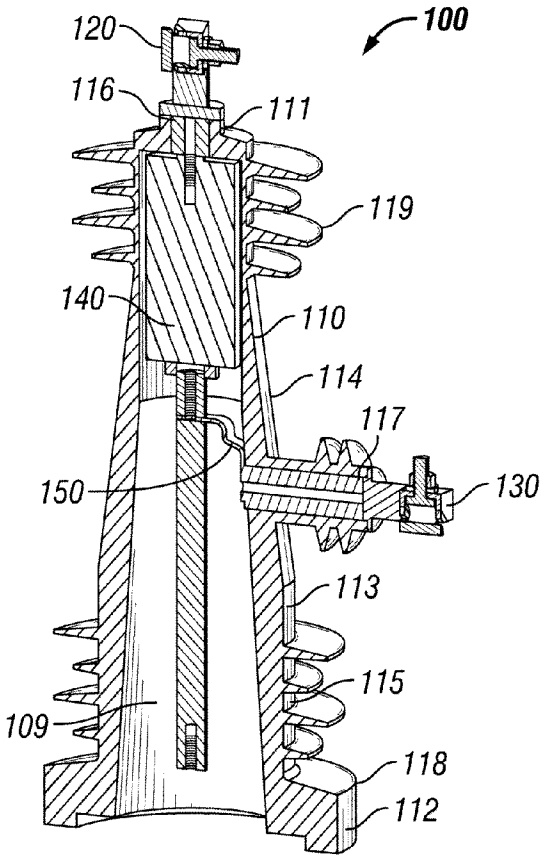
FIG. 1B (Prior Art)
FIG. 1B shows a perspective cross-sectional view of the conventional switching assembly of FIG. 1A in accordance with the prior art.
Figure 1A:
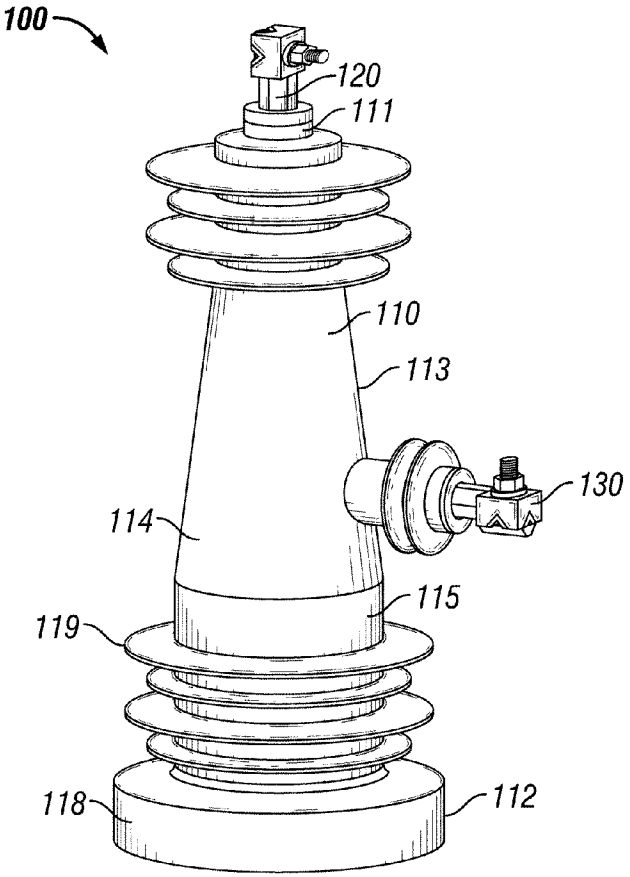
FIG. 1A (Prior Art)
FIG. 1A shows a perspective view of a conventional switching assembly in accordance with the prior art.
Figure 2B:
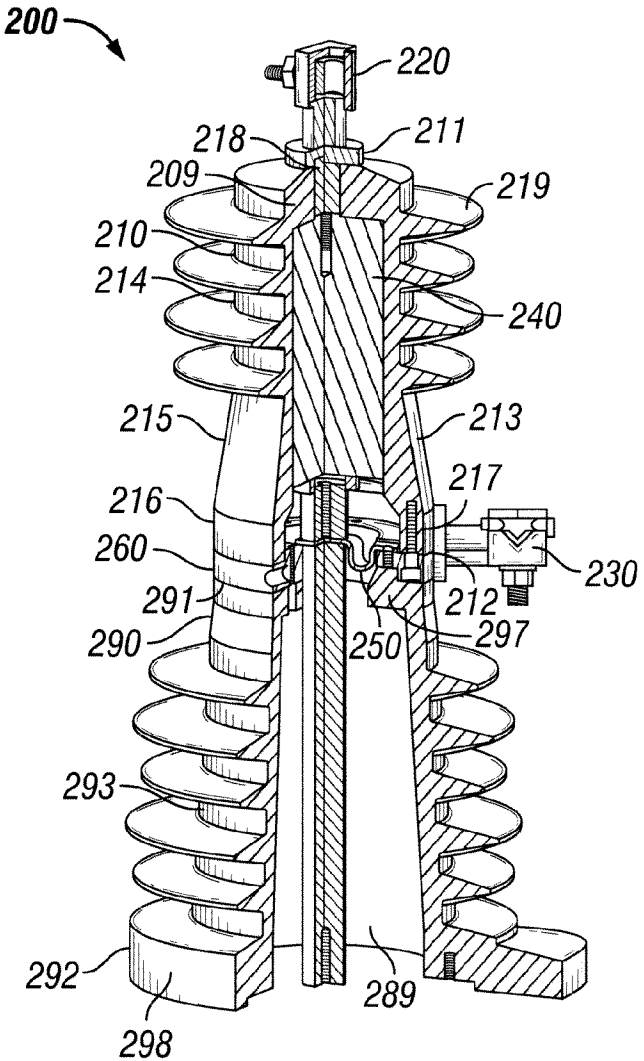
FIG. 2B shows a perspective cross-sectional view of the switching assembly of FIG. 2A in accordance with an exemplary embodiment.
Figure 2A:
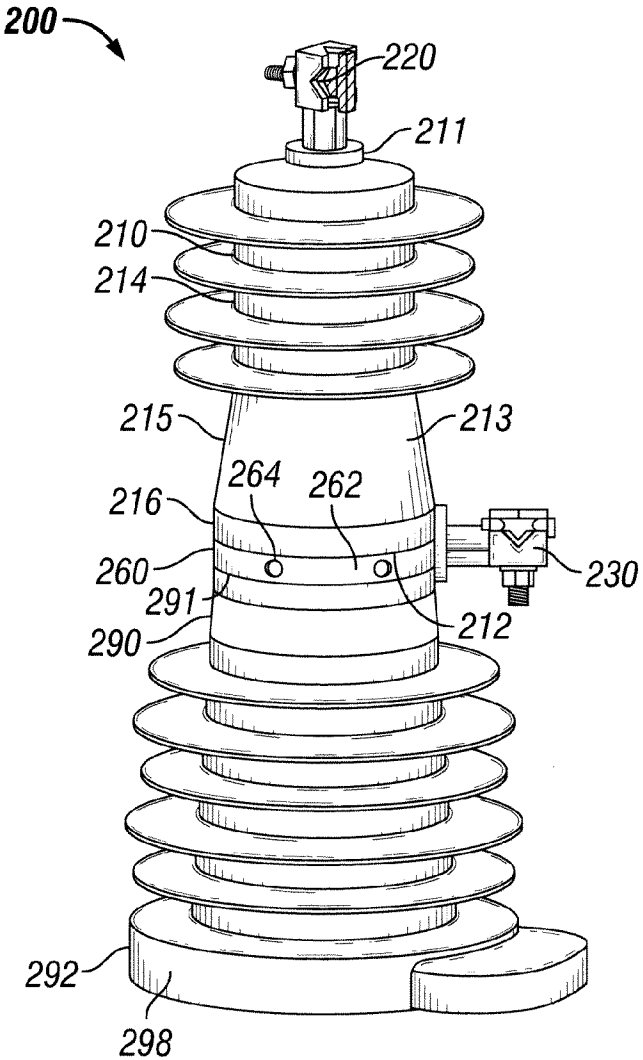
FIG. 2A shows a perspective view of a switching assembly in accordance with an exemplary embodiment.

The disclosure is better understood by reading the following description of non-limiting, exemplary embodiments with reference to the attached drawings, wherein like parts of each of the figures are identified by like reference characters throughout, and which are briefly described below. FIG. 2A shows a perspective view of a switching assembly 200 in accordance with an exemplary embodiment. FIG. 2B shows a perspective cross-sectional view of the switching assembly 200 of FIG. 2A in accordance with an exemplary embodiment. Referring to FIGS. 2A and 2B, the switching assembly 200 includes an upper bushing 210, a lower bushing 290, a modular terminal ring 260, an upper terminal 220, at least one lower terminal 230, and a switching medium 240. According to some exemplary embodiments, the switching assembly 200 is used in systems that interrupt the flow of electricity in a high voltage electrical circuit. A high voltage electrical circuit is defined as a circuit having 1000 volts or higher. However, the switching assembly 200 is usable in other types of electrical circuits, including low voltage electrical circuits, according to other exemplary embodiment. A low voltage electrical circuit is defined as a circuit having less than 1000 volts. Thus, the switching assembly 200 is usable in any type of electrical circuit.

The upper bushing 210 is integrally formed and includes a first end 211, a second end 212, a sidewall 213 extending from substantially the perimeter of the first end 211 to substantially the perimeter of the second end 212, and an upper bushing channel 209 extending axially from the first end 211 to the second end 212 within the upper bushing 210. The sidewall 213 includes a first portion 214, a second portion 215, and a third portion 216. The first portion 214 is substantially cylindrical-shaped and extends from the first end 211 towards the second end 212 and integrally transitions into the second portion 215. The second portion 215 is substantially conical-shaped and extends from the first portion 214 towards the second end 212 and integrally transitions into the third portion 216. The third portion 216 is substantially cylindrical-shaped and extends from the second end 212 towards the first end 211 and integrally transitions into the second portion 215. According to FIGS. 2A and 2B, the first end 211 has a smaller circumference than the second end 212; however, the first end 211 has a similar circumference or a larger circumference than the second end 212 according to other exemplary embodiments. Although, the upper bushing 210 is shown to include three integrally formed portions 214, 215, 216, the upper bushing 210 has fewer or greater portions according to other exemplary embodiments. Also, according to other exemplary embodiments, the upper bushing 210 is formed using separately formed components, and thereafter coupling them together using methods known to people having ordinary skill in the art, such as by welding. Although the sidewall 213 has been described with a particular shape, the sidewall 213 is formed in other geometric or non-geometric shapes in other exemplary embodiments.

According to some exemplary embodiments, the second end 212 is formed substantially planar. However, according to other exemplary embodiments, the second end 212 is formed substantially non-planar. As will be described below in further detail, a portion of the modular terminal ring 260 is inserted within the upper bushing channel 209 and a portion of the modular terminal ring 260 lies on the second end 212 when coupling the modular terminal ring 260 to the upper bushing 210. Thus, the second end 212 seems to form a first overhang 217 around the modular terminal ring 260, which is better depicted in FIGS. 3A and 3B. The second end 212 also includes one or more openings 450 (FIG. 4A) formed therein. These openings 450 (FIG. 4A) are used to couple the upper bushing 210 to the modular terminal ring 260. There are six openings 450 (FIG. 4A) formed radially in the second end 212 and are arranged about sixty degrees apart. However, greater or fewer openings 450 (FIG. 4A) are formed and are arranged from one another at different angles according to other exemplary embodiments. Although one feature has been provided for coupling the upper bushing 210 to the modular terminal ring 260, other features are available in other exemplary embodiments, which is described in further detail below.

The upper bushing 210 also includes an upper terminal opening 218 and a plurality of weathersheds 219. The upper terminal opening 218 is formed at the first end 211 and is dimensioned to receive the upper terminal 220. The upper terminal opening 218 includes upper terminal opening mating threads (not shown) positioned within according to some exemplary embodiments. The weathersheds 219 are integrally formed along the sidewall 213 and extend radially outward from the sidewall 213. A portion of the weathersheds 219 are located along the first portion 214 of the sidewall 213. Although there are no weathersheds 219 located along the second portion 215 and the third portion 216 of the sidewall 213, weathersheds 219 are located along any one or any combination of the first portion 214, the second portion 215, and the third portion 216 according to other exemplary embodiments. Although there are four weathersheds 219 fanned along the sidewall 213, the number of weathersheds 219 is greater or fewer in other exemplary embodiments. Additionally, the diameter of one or more weathersheds 219 is fabricated to be larger or smaller in other exemplary embodiments. The upper bushing 210 is fabricated using a polymer material; however, according to other exemplary embodiments, the upper bushing 210 is fabricated using other suitable materials known to people having ordinary skill in the art, such as an epoxy material.

The lower bushing 290 is integrally formed and includes a first end 291, a second end 292, a sidewall 293 extending from substantially the perimeter of the first end 291 to substantially the perimeter of the second end 292, and a lower bushing channel 289 extending axially from the first end 291 to the second end 292 within the lower bushing 290. The sidewall 293 is substantially cylindrical-shaped and extends from the first end 291 to the second end 292. According to FIGS. 2A and 2B, the second end 292 of the lower bushing 290 has a larger circumference than the first end 211 of the upper bushing 210 due to the flange 298 formed at the second end 292. Although, the lower bushing 290 is shown having a uniformly shaped sidewall 293, the sidewall 293 is non-uniformly shaped according to other exemplary embodiments. Also, according to other exemplary embodiments, the lower bushing 290 is formed using separately formed components, and thereafter coupling them together using methods known to people having ordinary skill in the art, such as by welding. Although the sidewall 293 has been described with a particular shape, the sidewall 293 is formed in other geometric or non-geometric shapes in other exemplary embodiments.

According to some exemplary embodiments, the first end 291 is formed with a first step 297 that elevationally raises the interior radial portion of the first end 291 with respect to the exterior radial portion of the first end 291. The first step 297 is better depicted in FIGS. 3A and 3B. However, according to other exemplary embodiments, the first end 291 is formed substantially planar or non-planar according to a different manner than the first step 297 described above. The first end 291 also includes one or more openings 460 (FIG. 4A) formed within the first step 297. These openings 460 (FIG. 4A) are used to couple the lower bushing 290 to the modular terminal ring 260. There are six openings 460 (FIG. 4A) formed radially in the first step 297 and are arranged about sixty degrees apart. However, greater or fewer openings 460 (FIG. 4A) are formed and are arranged from one another at different angles according to other exemplary embodiments. Although one feature has been provided for coupling the lower bushing 290 to the modular terminal ring 260, other features are available in other exemplary embodiments, which is described in further detail below.

The lower bushing 290 also includes the flange 298 and a plurality of weathersheds 219. The flange 298 is formed at the second end 292 and is coupleable to a tank (not shown), either in a sealed or non-sealed manner. According to some exemplary embodiments, a seal (not shown) is insertable into the underside area of the flange 298, which thereby allows the flange 298 to be sealably coupled to the tank. The weathersheds 219 are integrally formed along the sidewall 293 and extend radially outward from the sidewall 293. Although there are five weathersheds 219 formed along the sidewall 293, the number of weathersheds 219 is greater or fewer in other exemplary embodiments. Additionally, the diameter of one or more weathersheds 219 is fabricated to be larger or smaller in other exemplary embodiments. The lower bushing 290 is fabricated using a polymer material; however, according to other exemplary embodiments, the lower bushing 290 is fabricated using other suitable materials known to people having ordinary skill in the art, such as an epoxy material.

Figure 3A:
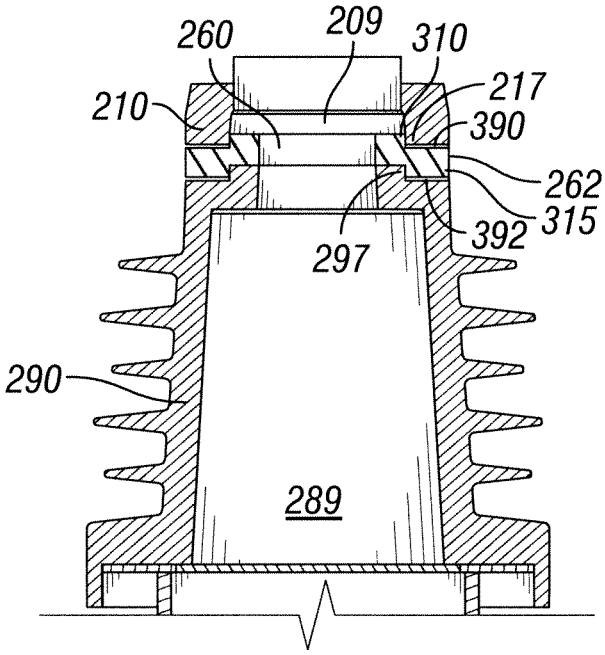
FIG. 3A shows a side cross-sectional view of a portion of the switching assembly of FIG. 2A that includes an upper bushing, a lower bushing, and a modular terminal ring in accordance with an exemplary embodiment.
Figure 3B:
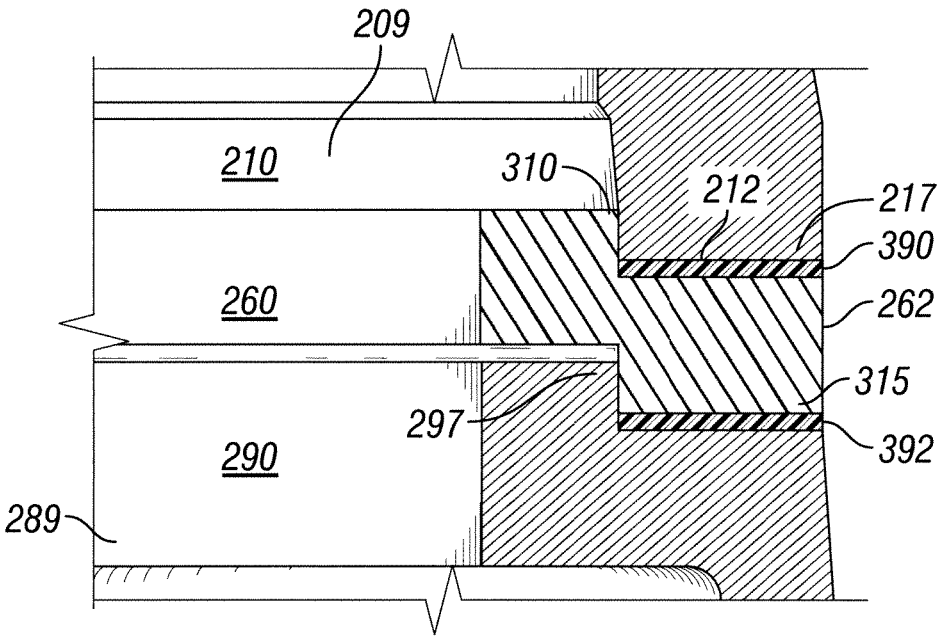
FIG. 3B shows a magnified side cross-sectional view of FIG. 3A in accordance with an exemplary embodiment.
Figure 4A:
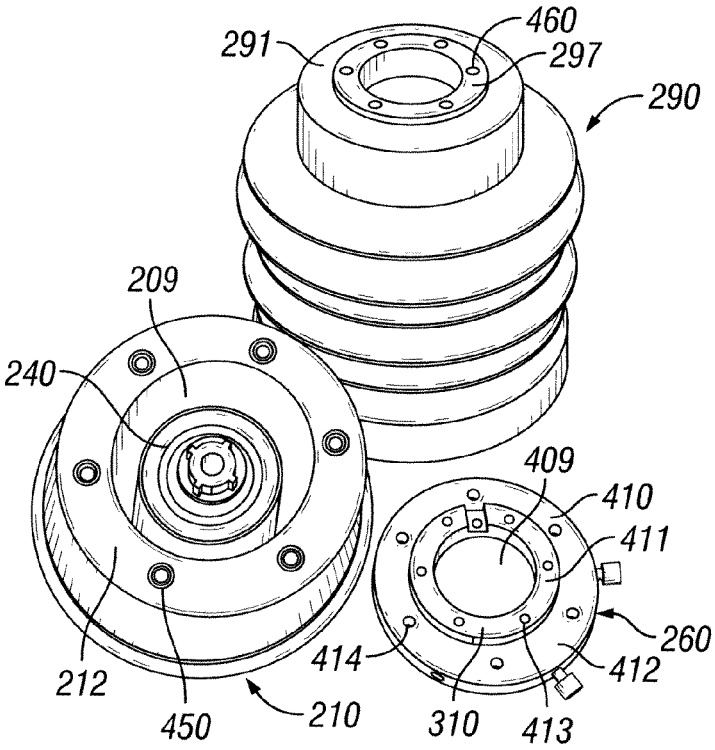
FIG. 4A shows a perspective view of a disassembled upper bushing, lower bushing, and modular terminal ring of the switching assembly of FIG. 2A in accordance with an exemplary embodiment.
Figure 4B:
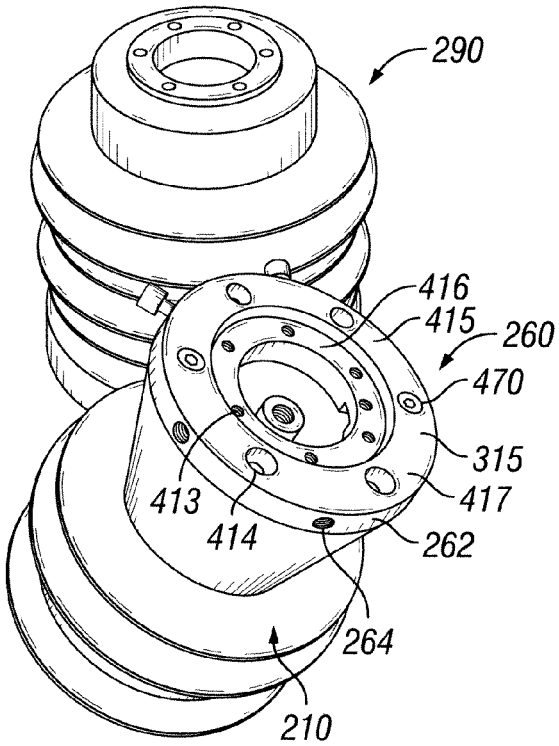
FIG. 4B shows a perspective view of a disassembled lower bushing and an assembled upper bushing and modular terminal ring of the switching assembly of FIG. 2A in accordance with an exemplary embodiment.

FIG. 3A shows a side cross-sectional view of a portion of the switching assembly 200 of FIG. 2A that includes the upper bushing 210, the lower bushing 290, and the modular terminal ring 260 in accordance with an exemplary embodiment. FIG. 3B shows a magnified side cross-sectional view of FIG. 3A in accordance with an exemplary embodiment. FIG. 4A shows a perspective view of a disassembled upper bushing 210, lower bushing 290, and modular terminal ring 260 of the switching assembly 200 of FIG. 2A in accordance with an exemplary embodiment. FIG. 4B shows a perspective view of a disassembled lower bushing 290 and an assembled upper bushing 210 and modular terminal ring 260 of the switching assembly 200 of FIG. 2A in accordance with an exemplary embodiment. Referring to FIGS. 2A, 2B, 3A, 3B, 4A, and 4B, the modular terminal ring 260 includes an upper surface 410, a lower surface 415, and a sidewall 262 extending from substantially the perimeter of the upper surface 410 to substantially the perimeter of the lower surface 415, and a modular terminal ring channel 409 extending from the upper surface 410 to the lower surface 415 axially within the modular terminal ring 260. The modular terminal ring 260 is ring-shaped; however, the modular terminal ring 260 is shaped in other geometric shapes or non-geometric shapes in other exemplary embodiments.

The upper surface 410 is formed with a second step 310 that elevationally raises an interior radial portion 411 of the upper surface 410 with respect to an exterior radial portion 412 of the upper surface 410. However, according to other exemplary embodiments, the upper surface 410 is formed substantially planar or non-planar according to a different manner than the second step 310 described above. The interior radial portion 411 is formed with one or more openings 413 aligned radially around the interior radial portion 411. There are six openings 413 separated about sixty degrees apart; however, there are greater or fewer openings arranged at greater or fewer degrees apart according to other exemplary embodiments. The openings 413 extend from the upper surface 410 to the lower surface 415; however, according to other exemplary embodiments, the openings 413 extend a portion of the distance from the lower surface 415 towards the upper surface 410. According to some exemplary embodiments, the openings 413 are used to couple the modular terminal ring 260 to the lower bushing 290. Similarly, the exterior radial portion 412 also is formed with one or more openings 414 aligned radially around the exterior radial portion 412. There are six openings 414 separated about sixty degrees apart; however, there are greater or fewer openings arranged at greater or fewer degrees apart according to other exemplary embodiments. The openings 414 extend from the upper surface 410 to the lower surface 415. According to some exemplary embodiments, the openings 414 are used to couple the modular terminal ring 260 to the upper bushing 210. The openings 414 are staggered with respect to openings 413; however, the openings 414 are aligned adjacently with the openings 413 in other exemplary embodiments. Although one feature has been provided for coupling the upper bushing 210 to the modular terminal ring 260 and another feature has been provided for coupling the lower bushing 290 to the modular terminal ring 260, other features are available in other exemplary embodiments, which is described in further detail below.

The lower surface 415 is formed with a second overhang 315 on an exterior radial portion 417 of the lower surface 415. However, according to other exemplary embodiments, the lower surface 415 is formed substantially planar or non-planar according to a different manner than the second overhang 315 described above. An interior radial portion 416 of the lower surface 415 is formed with the openings 413, as previously mentioned, aligned radially around the interior radial portion 416. Similarly, the exterior radial portion 417, which includes the second overhang 315, is formed with the openings 414, as previously mentioned, aligned radially around the exterior radial portion 417.

The sidewall 262 is formed along the perimeter of the modular terminal ring 260 and includes one or more lower terminal openings 264 arranged radially around the sidewall 262. The lower terminal openings 264 are formed substantially perpendicular with respect to the axially aligned modular terminal ring channel 409. There are six lower terminal openings 264 separated about sixty degrees apart; however, there are greater or fewer lower terminal openings arranged at greater or fewer degrees apart according to other exemplary embodiments. The lower terminal openings 264 can range from being about five degrees apart to about 355 degrees apart depending upon the design choices. According to some exemplary embodiments, the lower terminal openings 264 include lower terminal opening mating threads (not shown) which facilitate coupling of the lower terminal 230 to the modular terminal ring 260. Each lower terminal opening 264 is capable of accommodating a lower terminal 230. Thus, the switching assembly 200 is capable of having multiple lower terminals 230 and/or is capable of having the lower terminal 230 coupled in an accessible opening 264 without having to disassemble any portion of the switching assembly 200, including separating the flange 298 from the tank. The modular terminal ring 260 is fabricated using copper according to some exemplary embodiments; however, other suitable materials, such as copper, bronze, brass, metal alloys, and any other electrically conductive material can be used in other exemplary embodiments.

The upper terminal 220 is fabricated using an electrically conductive material and is inserted at least partially within the upper terminal opening 218. The upper terminal 220 includes threads (not shown) which couple to the upper terminal opening mating threads. Once coupled to the upper bushing 210, the exposed portion of the upper terminal 220 provides a connection point to an electrical source (not shown), thereby allowing current to enter into the conventional switching assembly 200. The shape and materials used to fabricate the upper terminal 220 are known to people having ordinary skill in the art.

The lower terminal 230 is fabricated using an electrically conductive material and is inserted at least partially within one of the lower terminal openings 264. The lower terminal 230 includes threads (not shown) which couple to the lower terminal opening mating threads. The lower terminal 230 is locatable at one of several lower terminal openings 264 that are positioned circumferentially around the modular terminal ring 260, thereby allowing the lower terminal 230 to be easily accessible during installation. Once coupled to the modular terminal ring 260, the exposed portion of the lower terminal 230 provides a connection point to a load (not shown), thereby allowing current to exit the switching assembly 200. The shape and materials used to fabricate the lower terminal 230 are known to people having ordinary skill in the art. Although the upper terminal 220 is electrically coupled to the electrical source and the lower terminal 230 provides a connection point to the load according to some exemplary embodiments, the upper terminal 220 is electrically coupled to the load and the lower terminal 230 provides a connection point to the electrical source in other exemplary embodiments.

The switching medium 240 is located within the upper bushing channel 209 and is electrically coupled to both the upper terminal 220 and the lower terminal 230 once the switch assembly 200 has been assembled. The switching medium 240 is a vacuum bottle according to some exemplary embodiments; however, the switching assembly 240 can be any other suitable device, such as a solid state switching device, according to other exemplary embodiments. The switching medium 240 is electrically coupled to the lower terminal 230 using an electrical pathway 250, which is located within either the upper bushing channel 209 or the lower bushing channel 289. The electrical pathway 250 can be a flexible copper wire according to some exemplary embodiments; however, other suitable conductive, flexible materials can be used in other exemplary embodiments. According to some exemplary embodiments, one end of the electrical pathway 250 is directly coupled to the modular terminal ring 260, thereby providing electricity to all of the lower terminal openings 264. When in the closed condition, the switching medium 240 allows electrical current to flow from the upper terminal 220 to the lower terminal 230. When in the open condition, however, the switching medium 240 prevents electrical current to flow from the upper terminal 220 to the lower terminal 230. Although not described in detail, other components can be inserted into either the upper bushing channel 209 or the lower bushing channel 289. For example, a buffer material (not shown), such as polyurethane foam, urethane, or silicone, is insertable within a portion of the upper bushing channel 209 which extends from about the upper portion of the switching medium 240 to about the uppermost portion of the upper bushing channel 209. The buffer material is usable in many types of switching mediums 240, such as a vacuum bottle type, to improve the resistance of electrical discharge across the device and act as a thermal expansion buffer. Although not shown, a control device is interfaced with the switching medium 240 through a series of electromechanical interconnections and/or one or more electronic interconnections, which determines when the switching medium 240 is to operate and interrupt the flow of current. This control device can be located within any of the upper bushing channel 209 or the lower bushing channel 289 or outside of both channels 209, 289 depending upon the design choices.

Figure 4C:
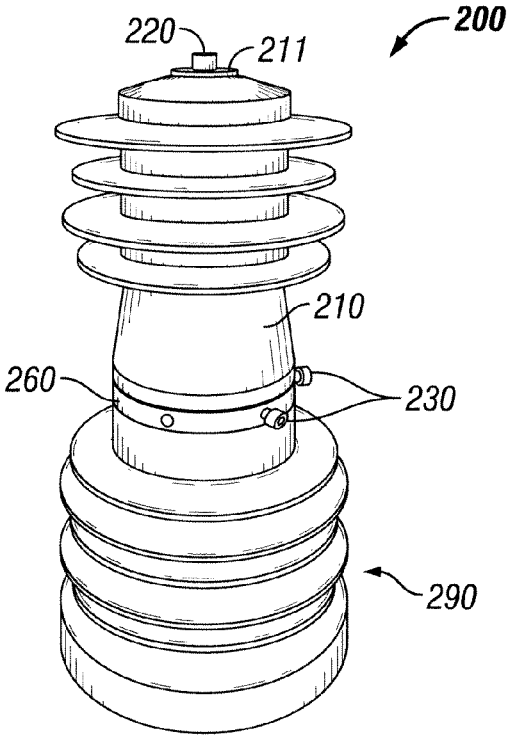
FIG. 4C shows a perspective view of the assembled switching assembly of FIG. 2A in accordance with an exemplary embodiment.

FIG. 4A shows a perspective view of a disassembled upper bushing 210, lower bushing 290, and modular terminal ring 260 of the switching assembly 200 of FIG. 2A in accordance with an exemplary embodiment. FIG. 4B shows a perspective view of a disassembled lower bushing 290 and an assembled upper bushing 210 and modular terminal ring 260 of the switching assembly 200 of FIG. 2A in accordance with an exemplary embodiment. FIG. 4C shows a perspective view of the assembled switching assembly 200 of FIG. 2A in accordance with an exemplary embodiment. Retelling to FIGS. 4A-4C, a method for assembling the switching assembly 200 is illustrated according to one exemplary embodiment. Although the description provided below is provided in a particular order, the order of assembling the switching assembly 200 is not meant to be limiting and the order can be altered in other exemplary embodiments.

Referring to FIG. 4A, the upper bushing 210, the lower bushing 290, and the modular terminal ring 260 are provided. The switching medium 240 is positioned within the upper bushing channel 209. Two lower terminals 230 are coupled to adjacently located lower terminal openings 264 of the modular terminal ring 260. Although two lower terminals 230 are coupled to the modular terminal ring 260, fewer or more lower terminals 230 can be coupled to the modular terminal ring if desired. Although the lower terminals 230 are illustrated as being coupled to the modular terminal ring 260 prior to assembly of the switching assembly 200, the lower terminal 230 can be coupled to the modular terminal ring 260 at any time, including at the end of the assembly process.

Referring to FIGS. 4A and 4B, the modular terminal ring 260 is coupled to the upper bushing 210. The upper surface 410 is placed adjacent to the second end 212 of the upper bushing 210. According to some exemplary embodiments, the interior radial portion 411 is inserted into the upper bushing channel 209, while the exterior radial portion 412 is placed adjacently on top of the second end 212. One or more of the openings 414 are vertically aligned with a respective opening 450 formed within the second end 212. A fastener 470 is inserted through one or more of the openings 414 and respective opening 450 to couple the modular terminal ring 260 to the upper bushing 210. The fastener 470 is a screw; however, according to other exemplary embodiments, the fastener 470 includes, but is not limited to, a bolt, a rivet, or any other suitable device. According to some exemplary embodiments, a first seal ring 390 (FIG. 3B) is placed upon the second end 212 prior to coupling the modular terminal ring 260 to the upper bushing 210. The first seal ring 390 includes openings (not shown) that align with the openings 414 of the second end 212, thereby allowing the fastener 470 to be inserted therethrough when coupling the terminal modular ring 260 to the upper bushing 210. Hence, the first seal ring 390 (FIG. 3B) is disposed between the second end 212 of the upper bushing 210 and the exterior radial portion 412 on the upper surface 410 of the modular terminal ring 260. Although not shown, the electrical pathway 250 (FIG. 2B) is electrically coupled between the modular terminal ring 260 and the switching medium 240. Additionally, any other components are placed within the channels 209, 289. Although one example has been provided for positioning the first seal ring 390 between the modular terminal ring 260 and the upper bushing 210, the first seal ring 390 is positionable in other locations between the modular terminal ring 260 and the upper bushing 210 in other exemplary embodiments. For example, the first seal ring 390 can be placed within grooves (not shown) formed within the interior radial portion 411 or the exterior radial portion 412. Thus, the first seal ring 390 is positionable on anon-planar surface according to some exemplary embodiments.

Referring to FIGS. 4A, 4B, and 4C, the lower bushing 290 is coupled to the modular terminal ring 260, which has previously been coupled to the upper bushing 210, to form the switch assembly 200. The lower surface 415 is placed adjacent to the first end 291 of the lower bushing 290. According to some exemplary embodiments, the interior radial portion 416 is placed adjacently to the first step 297 of the first end 291 and the exterior radial portion 417 is placed adjacently to the remaining portion of the first end 291. One or more of the openings 413 are vertically aligned with a respective opening 460 formed within the first step 297 of the first end 291. A fastener (not shown), similar to fastener 470, is inserted through one or more of the openings 413 and respective opening 460 to couple the modular terminal ring 260 to the lower bushing 290. The fastener is inserted through openings 413, 460 from the underside area of the lower bushing 290. According to some exemplary embodiments, a second seal ring 392 (FIG. 3B) is placed upon the exterior radial portion 417 of the modular terminal ring 260 prior to coupling the modular terminal ring 260 to the lower bushing 290. Hence, the second seal ring 392 (FIG. 3B) is disposed between the first end 291 of the lower bushing 290 and the exterior radial portion 417 on the lower surface 415 of the modular terminal ring 260. The upper terminal 220 is coupled to the first end 211 of the upper bushing 210. Although the upper terminal 220 is illustrated as being coupled to the first end 211 of the upper bushing 210 after assembly of the modular terminal ring 260 with both the lower bushing 290 and the upper bushing 210, the upper terminal 220 can be coupled to the first end 211 of the upper bushing 210 at any time, including at the beginning of the assembly process. Although one example has been provided for positioning the second seal ring 392 between the modular terminal ring 260 and the lower bushing 290, the second seal ring 392 is positionable in other locations between the modular terminal ring 260 and the lower bushing 290 in other exemplary embodiments. For example, the second seal ring 392 can be placed within grooves (not shown) formed within the interior radial portion 416 or the exterior radial portion 417. Thus, the second seal ring 392 is positionable on a non-planar surface according to some exemplary embodiments.

As previously mentioned, although one set of features, which includes openings 450 in the upper bushing's second end 212, openings 460 in the lower bushing's first end 291, and openings 413, 414 in the modular terminal ring 260, has been described for coupling the modular terminal ring 260 to the upper bushing 210 and the lower bushing 290, other features are used in other exemplary embodiments. One example of another set of features used to couple the modular terminal ring 260 to the upper bushing 210 and the lower bushing 290 in other exemplary embodiments includes threads (not shown) and mating threads (not shown). The upper bushing's second end 212 includes threads that either extend outwardly from the second end 212 or inwardly into a portion of the upper bushing 210, while the modular terminal ring's upper surface 410 includes mating threads that either extend outwardly from the upper surface 410 or inwardly into at least a portion of the modular terminal ring 260 depending upon the design choices. Thus, the modular terminal ring 260 is coupleable to the upper bushing 210 by having one of the modular terminal ring 260 or the upper bushing 210 threaded into the other component. Similarly, The lower bushing's first end 291 includes threads that either extend outwardly from the first end 291 or inwardly into a portion of the lower bushing 290, while the modular terminal ring's lower surface 415 includes mating threads that either extend outwardly from the lower surface 415 or inwardly into at least a portion of the modular terminal ring 260 depending upon the design choices. Thus, the modular terminal ring 260 is coupleable to the lower bushing 290 by having one of the modular terminal ring 260 or the lower bushing 290 threaded into the other component. One example of another set of features used to couple the modular terminal ring 260 to the upper bushing 210 and the lower bushing 290 in other exemplary embodiments includes a set of interlocking ears or flanges (not shown), where one set is on the upper bushing's second end 212 and the modular terminal ring's upper surface 410 while the other set is on the lower bushing's first end 291 and the modular terminal ring's lower surface 415. These sets of interlocking ears or flanges are similar to a "twist-lock" mechanism where each component is rotated, for example, ninety degrees in some exemplary embodiments, to lock it into the adjacent component. These sets of interlocking ears or flanges are used to couple the modular terminal ring 260 to the upper bushing 210 and the lower bushing 290 and is accomplishable by people having ordinary skill in the art and having the benefit of the present disclosure.

Figure 5A:
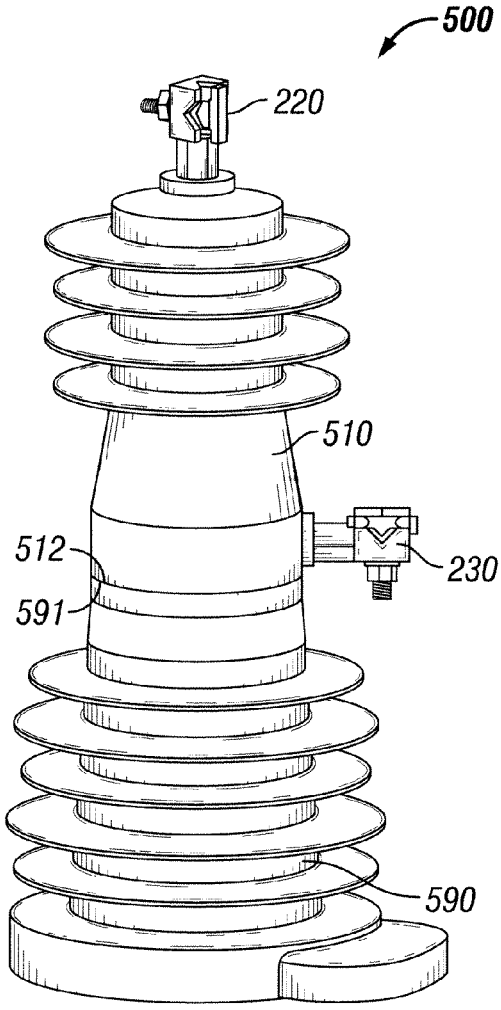
FIG. 5A shows a perspective view of a switching assembly in accordance with another exemplary embodiment.
Figure 5B:
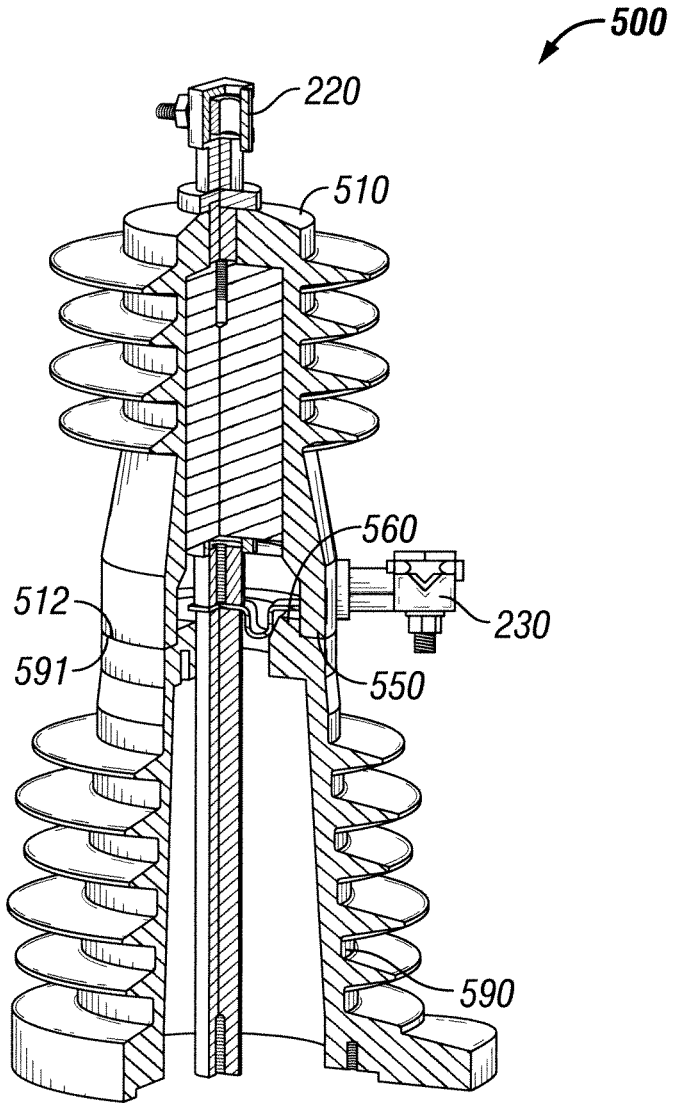
FIG. 5B shows a perspective cross-sectional view of the switching assembly of FIG. 5A in accordance with another exemplary embodiment.

FIG. 5A shows a perspective view of a switching assembly 500 in accordance with another exemplary embodiment. FIG. 5B shows a perspective cross-sectional view of the switching assembly of FIG. 5A in accordance with another exemplary embodiment. Referring to FIGS. 5A and 5B, the switching assembly 500 includes an upper bushing 510, a lower bushing 590, an upper terminal 220, and a lower terminal 230. The switching assembly 500 is similar to the switching assembly 200 (FIG. 2A) except that a modular terminal ring is not included within the design of the switching assembly 500. According to one exemplary embodiment, the lower terminal 230 is coupled to the upper bushing 510; however, according to other exemplary embodiments, the lower terminal 230 is coupled to the lower bushing 590. The upper bushing 510 includes a bottom end 512 which is configured to be sealably coupled to a top end 591 of the lower bushing 590. The bottom end 512 of the upper bushing 510 and the top end 591 of the lower bushing 590 include one or more of the features described above to facilitate the coupling of the upper bushing 510 to the lower bushing 590. These features include openings (not shown) within the bottom end 512 of the upper bushing 510 and the top end 591 of the lower bushing 590 which vertically align with each other to receive one or more fasteners (not shown) in the manner previously described. In some exemplary embodiments, the bottom end 512 of the upper bushing 510 and the top end 591 of the lower bushing 590 also include one or more of overhangs 550 and steps 560. In some exemplary embodiments, a seal (not shown) is disposed between the bottom end 512 of the upper bushing 510 and the top end 591 of the lower bushing 590.

Referring to FIGS. 2A-5, the switching assembly 200, 500 includes two or more bushings 210, 290, 510, 590 to form the switching assembly 200, 500. Thus, each bushing 210, 290, 510, 590 is smaller when manufactured which reduces any air bubble formation within the casting of the bushing 210, 290, 510, 590. Also, since the bushings 210, 290, 510, 590 are manufactured smaller in size, positioning the internal components, which include the switching medium 240 and the electrical pathway 250, becomes easier than when installing internal components within a larger single piece bushing. Further, one or more of the bushings 210, 290, 510, 590 are replaceable with a different type of bushing, thereby changing the characteristics of the switching assembly 200, 500. For example, the length of switching assembly 200, 500 can be increased or decreased by replacing at least one of the bushings 210, 290, 510, 590 with a different bushing length. In another example, the number or size of weathersheds 119 can be altered when replacing at least one of the bushings 210, 290, 510, 590 with a different bushing type. Thus, changing the characteristics of the switching assembly 200, 500 no longer requires changing the entire switching assembly 200, 500.

Referring to FIGS. 2A-4C, the switching assembly 200 includes steps 297, 310 and overhangs 315, 217 to reduce the chance of moisture and contamination from entering the switching assembly 200. Typically, these switching assemblies 200 are installed in a substantially vertical orientation. Thus, the combination of steps 297, 310 and overhangs 315, 217 provide for a vertical barrier that reduces the ingress of moisture and/or contamination from the outside environment into the switching assembly 200. The seals 390, 392 also are provided to reduce the chance of moisture and contamination from entering the switching assembly 200.

Although each exemplary embodiment has been described in detail, it is to be construed that any features and modifications that are applicable to one embodiment are also applicable to the other embodiments. Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A switching assembly, comprising:

an upper bushing forming an upper bushing channel therein and an upper terminal opening extending from the upper bushing channel through an outer surface of the upper bushing;

a lower bushing forming a lower bushing channel therein;

a modular terminal ring comprising an upper surface, a lower surface, and a sidewall extending substantially from the perimeter of the upper surface to substantially the perimeter of the lower surface, the sidewall forming at least one lower terminal opening around the perimeter of the sidewall, the upper surface being sealably coupled to the upper bushing, the lower surface being sealably coupled to the lower bushing;

an upper terminal coupled to the upper bushing through the upper terminal opening;

at least one lower terminal, each lower terminal being coupled to one of the lower terminal openings; and a switching medium disposed within the upper bushing channel, the switching medium electrically coupling the upper terminal to the lower terminals when in a closed state, and the switching medium electrically discoupling the upper terminal to the lower terminals when in an open state.

2. The switching assembly of claim 1, wherein the upper bushing comprises a first end, a second end, an upper bushing sidewall extending substantially from the perimeter of the first end to substantially the perimeter of the second end, and one or more weathersheds extending radially outward along at least a portion of the upper bushing sidewall, wherein the second end is sealably coupled to the upper surface of the modular terminal ring.

3. The switching assembly of claim 2, wherein the upper terminal opening is formed within the first end of the upper bushing.

4. The switching assembly of claim 1, wherein the lower bushing comprises a first end, a second end, a lower bushing sidewall extending substantially from the perimeter of the first end to substantially the perimeter of the second end, and one or more weathersheds extending radially outward along at least a portion of the lower bushing sidewall, wherein the first end is sealably coupled to the lower surface of the modular terminal ring.

5. The switching assembly of claim 1, further comprising an electrical pathway electrically coupling the switching medium to the lower terminal, the electrical pathway being fabricated using a flexible material.

6. The switching assembly of claim 5, wherein the modular terminal ring is fabricated using a conductive material, and wherein one end of the electrical pathway is coupled to the modular terminal ring, thereby electrically coupling each of the lower terminals to the switching medium through the electrical pathway.

7. The switching assembly of claim 1, wherein adjacent lower terminal openings are positioned at an angle ranging from about five degrees to about 355 degrees.

8. The switching assembly of claim 7, wherein the angle ranges from about twenty-five degrees to about ninety degrees.

9. The switching assembly of claim 1, wherein the upper surface of the modular terminal ring comprises a first interior portion and a first exterior portion, the first interior portion forming a first step, and wherein the lower surface of the modular terminal ring comprises a second interior portion and a second exterior portion, the second exterior portion forming a first overhang.

10. The switching assembly of claim 9, wherein the upper bushing comprises a first end, a second end, and an upper bushing sidewall extending substantially from the perimeter of the first end to substantially the perimeter of the second end, the second end being sealably coupled to the first exterior portion of the modular terminal ring, and the first interior portion of the modular terminal ring being inserted into a portion of the upper bushing channel.

11. The switching assembly of claim 10, wherein the second end is sealably coupled to the first exterior portion of the modular terminal ring using a first seal.

12. The switching assembly of claim 10, wherein the lower bushing comprises a first end, a second end, and a lower bushing sidewall extending substantially from the perimeter of the first end to substantially the perimeter of the second end, the first end comprising a third interior portion and a third exterior portion, the third interior portion forming a second step, the third interior portion being coupled to the second interior portion of the modular terminal ring, and the third exterior portion being sealably coupled to the second exterior portion of the modular terminal ring.

13. The switching assembly of claim 12, wherein the third exterior portion is sealably coupled to the second exterior portion of the modular terminal ring using a second seal.

14. A switching assembly, comprising;

an upper bushing forming an upper bushing channel therein and an upper terminal opening extending from the upper bushing channel through an outer surface of the upper bushing;

a lower bushing forming a lower bushing channel therein, the lower bushing being sealably coupled to the upper bushing;

an upper terminal coupled to the upper bushing through the upper terminal opening;

at least one lower terminal, each lower terminal being coupled to at least one lower terminal opening, the lower terminal openings being formed within at least one of the upper bushing and the lower bushing;

a switching medium disposed within the upper bushing channel, the switching medium electrically coupling the upper terminal to the lower terminals when in a closed state, and the switching medium electrically discoupling the upper terminal to the lower terminals when in an open state; and an electrical pathway electrically coupling the switching medium to the lower terminal, the electrical pathway being fabricated using a flexible material.

15. The switching assembly of claim 14, wherein the upper bushing comprises a first end, a second end, an upper bushing sidewall extending substantially from the perimeter of the first end to substantially the perimeter of the second end, and one or more weathersheds extending radially outward along at least a portion of the upper bushing sidewall, wherein the lower bushing comprises a first end, a second end, a lower bushing sidewall extending substantially from the perimeter of the first end to substantially the perimeter of the second end, and one or more weathersheds extending radially outward along at least a portion of the lower bushing sidewall, and wherein the second end of the upper bushing is sealably coupled to the first end of the lower bushing.

16. The switching assembly of claim 15, wherein the upper terminal opening is formed within the first end of the upper bushing.

17. The switching assembly of claim 14, wherein adjacent lower terminal openings are positioned at an angle ranging from about five degrees to about 355 degrees.

18. The switching assembly of claim 17, wherein the angle ranges from about twenty-five degrees to about ninety degrees.

19. The switching assembly of claim 14, wherein the upper bushing comprises a first end, a second end, an upper bushing sidewall extending substantially from the perimeter of the first end to substantially the perimeter of the second end, wherein the lower bushing comprises a first end, a second end, a lower bushing sidewall extending substantially from the perimeter of the first end to substantially the perimeter of the second end, the first end of the lower bushing comprising a first interior portion and a first exterior portion, the first interior portion forming a step, the first interior portion being inserted into a portion of the upper bushing channel, the first exterior portion being sealably coupled to the second end of the upper bushing.

20. The switching assembly of claim 19, wherein the first exterior portion is sealably coupled to the second end of the upper bushing using a seal.

21. A method for assembling a switching assembly, comprising:

obtaining an upper bushing, a lower bushing, and a modular terminal ring;

inserting a switching medium into an upper bushing channel formed within the upper bushing;

sealably coupling one end of the modular terminal ring to one end of the upper bushing;

electrically coupling the switching medium to the modular terminal ring using an electrical pathway;

sealably coupling an opposing end of the modular terminal ring to one end of the lower bushing;

coupling an upper terminal to the upper bushing through an upper terminal opening formed within the upper bushing; and coupling at least one lower terminal to the modular terminal ring through at least one lower terminal opening formed around the perimeter of the modular terminal ring, wherein the switching medium electrically couples the upper terminal to the lower terminals when in a closed state, and the switching medium electrically discouples the upper terminal to the lower terminals when in an open state.

22. The method of claim 21, further comprising placing a first seal between the modular terminal ring and the upper bushing and placing a second seal between the modular terminal ring and the lower bushing.

23. The method of claim 21, wherein adjacent lower terminal openings are positioned along the perimeter of the modular terminal ring at an angle ranging from about five degrees to about 355 degrees.

24. The method of claim 21, wherein an upper surface of the modular terminal ring comprises a first interior portion and a first exterior portion, the first interior portion forming a first step, and wherein a lower surface of the modular terminal ring comprises a second interior portion and a second exterior portion, the second exterior portion forming a first overhang.

* * * * *